US006880926B2

(12) United States Patent
Childs et al.

(10) Patent No.: US 6,880,926 B2
(45) Date of Patent: Apr. 19, 2005

(54) CIRCULATION THROUGH COMPOUND SLOTS

(75) Inventors: Ashley E. Childs, Corvallis, OR (US); Jeffrey S. Hess, Corvallis, OR (US); James Patrick Kearns, Corvallis, OR (US); Steve D. Napack, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/286,074

(22) Filed: Oct. 31, 2002

(65) Prior Publication Data

US 2004/0085417 A1 May 6, 2004

(51) Int. Cl.[7] ..... B41J 2/18
(52) U.S. Cl. ..... 347/89
(58) Field of Search ..... 347/20, 40, 42, 347/85–87, 89

(56) References Cited

U.S. PATENT DOCUMENTS

| | | | | |
|---|---|---|---|---|
| 4,432,003 A | * | 2/1984 | Barbero et al. | 347/55 |
| 4,601,777 A | | 7/1986 | Hawkins et al. | |
| 4,929,963 A | | 5/1990 | Balazar | |
| 5,317,346 A | | 5/1994 | Garcia | |
| 5,608,436 A | | 3/1997 | Baughman et al. | |
| 5,691,754 A | | 11/1997 | Ta | |
| 5,701,148 A | * | 12/1997 | Moynihan et al. | 347/92 |
| 5,818,485 A | | 10/1998 | Rezanka | |
| 5,871,656 A | | 2/1999 | Silverbrook | |
| 5,936,650 A | | 8/1999 | Ouchida et al. | |
| 5,971,527 A | | 10/1999 | Peeters et al. | |
| 6,039,442 A | * | 3/2000 | Hagiwara et al. | 347/89 |
| 6,107,209 A | | 8/2000 | Ohkuma | |
| 6,132,034 A | | 10/2000 | Miller | |
| 6,227,660 B1 | | 5/2001 | McClelland et al. | |
| 6,343,857 B1 | | 2/2002 | Cowger | |
| 6,428,156 B1 | | 8/2002 | Waller et al. | |

FOREIGN PATENT DOCUMENTS

| | | |
|---|---|---|
| EP | 0575983 | 6/1997 |
| EP | 0841167 | 10/1997 |
| JP | 58187369 | 1/1983 |
| JP | 60137655 | 7/1985 |
| WO | WO 01/12442 | 2/2001 |
| WO | WO 01/49493 | 7/2001 |

OTHER PUBLICATIONS

Copy of European Search Report Application No. EP03010417 mailed on Feb. 18, 2004.

* cited by examiner

*Primary Examiner*—Anh T. N. Vo

(57) ABSTRACT

A fluid ejection device includes a substrate having a first side and a second side opposite the first side, and a plurality of drop ejecting elements formed on the first side of the substrate. The substrate includes a first opening formed in the first side and a plurality of second openings formed in the second side with each of the second openings communicating with the first opening, wherein the second openings and the first opening are adapted to circulate fluid through the substrate.

38 Claims, 5 Drawing Sheets

CIRCULATION THROUGH COMPOUND SLOTS

THE FIELD OF THE INVENTION

The present invention relates generally to fluid ejection devices, and more particularly to circulation of fluid through a fluid ejection device.

BACKGROUND OF THE INVENTION

A conventional inkjet printing system, as one embodiment of a fluid ejection system, includes a printhead, an ink supply which supplies liquid ink to the printhead, and an electronic controller which controls the printhead. The printhead, as one embodiment of a fluid ejection device, ejects ink drops through a plurality of orifices or nozzles and toward a print medium, such as a sheet of paper, so as to print onto the print medium. Typically, the orifices are arranged in one or more arrays such that properly sequenced ejection of ink from the orifices causes characters or other images to be printed upon the print medium as the printhead and the print medium are moved relative to each other.

In some fluid ejection devices, such as printheads, a plurality of drop ejecting elements are formed on a substrate and fluid is routed to ejection chambers of the drop ejecting elements through a slot or opening in the substrate. Unfortunately, air bubbles and/or particles which can degrade operation of the fluid ejection device may collect within the opening of the substrate. In addition, heat which can also affect operation of the fluid ejection device may be generated during operation of the drop ejecting elements.

Accordingly, it is desired to circulate fluid through the fluid ejection device to facilitate the removal of air bubbles from and/or dissipate heat generated in the fluid ejection device.

SUMMARY OF THE INVENTION

A fluid ejection device includes a substrate having a first side and a second side opposite the first side, and a plurality of drop ejecting elements formed on the first side of the substrate. The substrate includes a first opening formed in the first side and a plurality of second openings formed in the second side with each of the second openings communicating with the first opening, wherein the second openings and the first opening are adapted to circulate fluid through the substrate.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
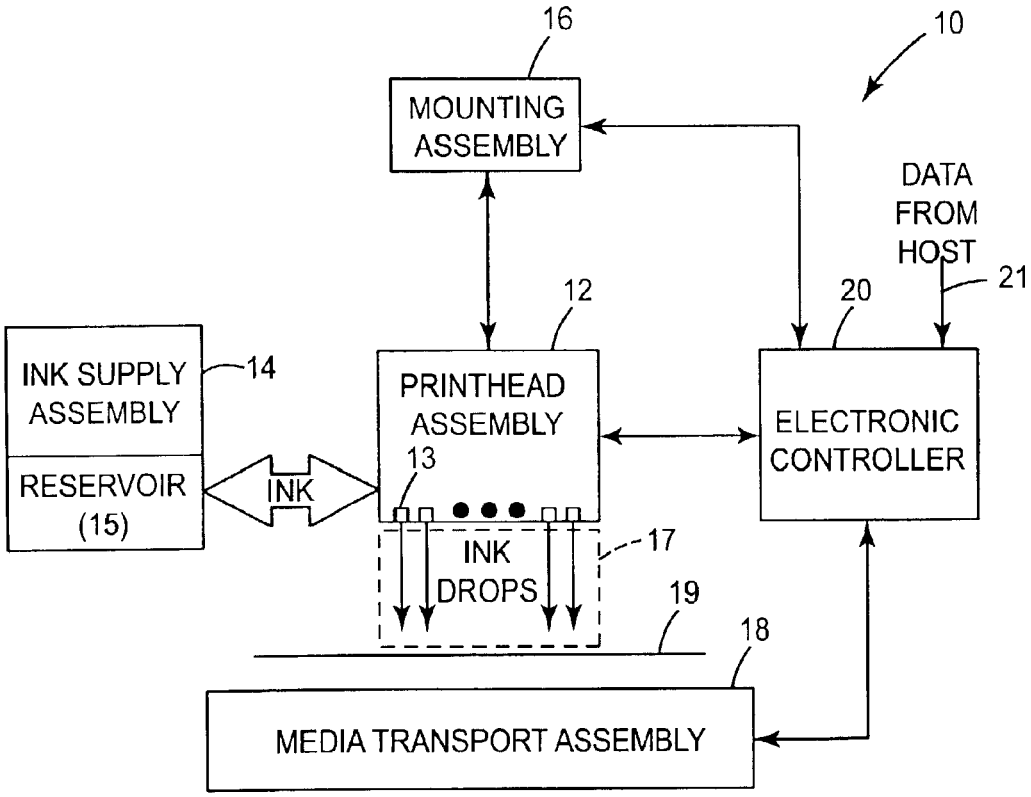
FIG. 1 is a block diagram illustrating one embodiment of an inkjet printing system according to the present invention.

FIG. 1 illustrates one embodiment of an inkjet printing system 10 according to the present invention. Inkjet printing system 10 constitutes one embodiment of a fluid ejection system which includes a fluid ejection assembly, such as an inkjet printhead assembly 12, and a fluid supply assembly, such as an ink supply assembly 14. In the illustrated embodiment, inkjet printing system 10 also includes a mounting assembly 16, a media transport assembly 18, and an electronic controller 20.

Inkjet printhead assembly 12, as one embodiment of a fluid ejection assembly, is formed according to an embodiment of the present invention, and includes one or more printheads or fluid ejection devices which eject drops of ink or fluid through a plurality of orifices or nozzles 13. In one embodiment, the drops are directed toward a medium, such as print medium 19, so as to print onto print medium 19. Print medium 19 is any type of suitable sheet material, such as paper, card stock, transparencies, Mylar, and the like. Typically, nozzles 13 are arranged in one or more columns or arrays such that properly sequenced ejection of ink from nozzles 13 causes, in one embodiment, characters, symbols, and/or other graphics or images to be printed upon print medium 19 as inkjet printhead assembly 12 and print medium 19 are moved relative to each other.

Ink supply assembly 14, as one embodiment of a fluid supply assembly, supplies ink to printhead assembly 12 and includes a reservoir 15 for storing ink. As such, ink flows from reservoir 15 to inkjet printhead assembly 12. In one embodiment, as described below, ink supply assembly 14 and inkjet printhead assembly 12 form a recirculating ink delivery system. As such, ink flows back to reservoir 15 from inkjet printhead assembly 12. In one embodiment, inkjet printhead assembly 12 and ink supply assembly 14 are housed together in an inkjet or fluidjet cartridge or pen. In another embodiment, ink supply assembly 14 is separate from inkjet printhead assembly 12 and supplies ink to inkjet printhead assembly 12 through an interface connection, such as a supply tube.

Mounting assembly 16 positions inkjet printhead assembly 12 relative to media transport assembly 18 and media transport assembly 18 positions print medium 19 relative to inkjet printhead assembly 12. Thus, a print zone 17 is defined adjacent to nozzles 13 in an area between inkjet printhead assembly 12 and print medium 19. In one embodiment, inkjet printhead assembly 12 is a scanning type printhead assembly and mounting assembly 16 includes a carriage for moving inkjet printhead assembly 12 relative to media transport assembly 18. In another embodiment, inkjet printhead assembly 12 is a non-scanning type printhead assembly and mounting assembly 16 fixes inkjet printhead assembly 12 at a prescribed position relative to media transport assembly 18.

Electronic controller 20 communicates with inkjet printhead assembly 12, mounting assembly 16, and media transport assembly 18. Electronic controller 20 receives data 21 from a host system, such as a computer, and includes memory for temporarily storing data 21. Typically, data 21 is sent to inkjet printing system 10 along an electronic, infrared, optical or other information transfer path. Data 21 represents, for example, a document and/or file to be printed. As such, data 21 forms a print job for inkjet printing system 10 and includes one or more print job commands and/or command parameters.

In one embodiment, electronic controller 20 provides control of inkjet printhead assembly 12 including timing control for ejection of ink drops from nozzles 13. As such, electronic controller 20 defines a pattern of ejected ink drops which form characters, symbols, and/or other graphics or images on print medium 19. Timing control and, therefore, the pattern of ejected ink drops, is determined by the print job commands and/or command parameters. In one embodiment, logic and drive circuitry forming a portion of electronic controller 20 is located on inkjet printhead assembly 12. In another embodiment, logic and drive circuitry is located off inkjet printhead assembly 12.

Figure 2:
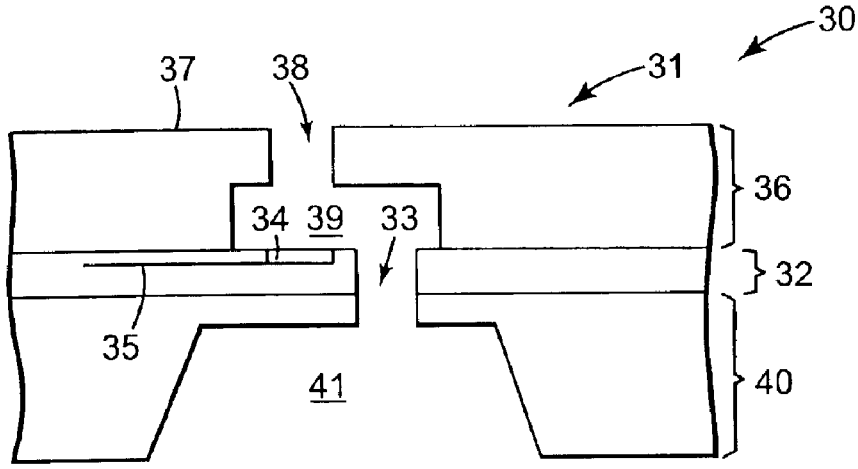
FIG. 2 is a schematic cross-sectional view illustrating one embodiment of a portion of a fluid ejection device according to the present invention.

FIG. 2 illustrates one embodiment of a portion of a fluid ejection device 30 of inkjet printhead assembly 12. Fluid ejection device 30 includes an array of drop ejecting elements 31. Drop ejecting elements 31 are formed on a substrate 40 which has a fluid (or ink) feed slot 41 formed therein. As such, fluid feed slot 41 provides a supply of fluid (or ink) to drop ejecting elements 31. Substrate 40 is formed, for example, of silicon, glass, or a stable polymer.

In one embodiment, each drop ejecting element 31 includes a thin-film structure 32 with a firing resistor 34 and an orifice layer 36. Thin-film structure 32 has a fluid (or ink) feed channel 33 formed therein which communicates with fluid feed slot 41 of substrate 40. Orifice layer 36 has a front face 37 and a nozzle opening 38 formed in front face 37. Orifice layer 36 also has a nozzle chamber 39 formed therein which communicates with nozzle opening 38 and fluid feed channel 33 of thin-film structure 32. Firing resistor 34 is positioned within nozzle chamber 39 and includes leads 35 which electrically couple firing resistor 34 to a drive signal and ground.

Thin-film structure 32 is formed, for example, by one or more passivation or insulation layers of silicon dioxide, silicon carbide, silicon nitride, tantalum, poly-silicon glass, or other suitable material. In one embodiment, thin-film structure 32 also includes a conductive layer which defines firing resistor 34 and leads 35. The conductive layer is formed, for example, by aluminum, gold, tantalum, tantalum-aluminum, or other metal or metal alloy.

In one embodiment, during operation, fluid flows from fluid feed slot 41 to nozzle chamber 39 via fluid feed channel 33. Nozzle opening 38 is operatively associated with firing resistor 34 such that droplets of fluid are ejected from nozzle chamber 39 through nozzle opening 38 (e.g., normal to the plane of firing resistor 34) and toward a medium upon energization of firing resistor 34.

Example embodiments of fluid ejection device 30 include a thermal printhead, as previously described, a piezoelectric printhead, a flex-tensional printhead, or any other type of fluidjet ejection device known in the art. In one embodiment, fluid ejection device 30 is a fully integrated thermal inkjet printhead.

Figure 3:
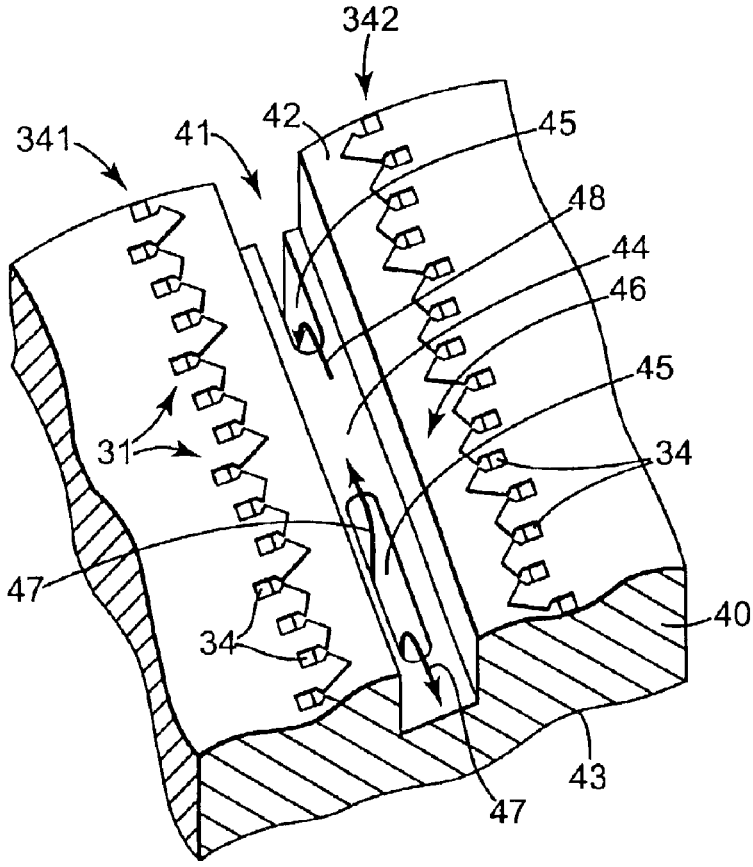
FIG. 3 is a schematic perspective view illustrating one embodiment of a portion of a fluid ejection device according to the present invention.

In one embodiment, as illustrated in FIG. 3, substrate 40 of fluid ejection device 30 has a first side 42 and a second side 43. Second side 43 is opposite of first side 42 and, in one embodiment, oriented substantially parallel with first side 42. In addition, fluid feed slot 41 of substrate 40 includes a first slot or opening 44 and a plurality of second slots or openings 45. First opening 44 is formed in and communicates with first side 42 of substrate 40 and second openings 45 are formed in and communicate with second side 43 of substrate 40. Second openings 45 communicate with first opening 44 so as to form an opening 46 through substrate 40. Opening 46, including first opening 44 and second openings 45, may be formed in substrate 40 as described, for example, in U.S. patent application Ser. Nos. 10/062,050 and 10/061,514, each entitled "Substrate and Method of Forming Substrate for Fluid Ejection Device" and assigned to the assignee of the present invention.

In one embodiment, drop ejecting elements 31 of fluid ejection device 30 are formed on first side 42 of substrate 40. Thus, first side 42 forms a frontside of substrate 40 and second side 43 forms a backside of substrate 40 with fluid (or ink) flowing through opening 46 from the backside of substrate 40 to the frontside of substrate 40. As such, fluid is supplied to first opening 44 through second openings 45, as illustrated by arrows 47. In one embodiment, as described below, fluid is circulated along first opening 44 and through second openings 45, as illustrated by arrow 48. Accordingly, opening 46 provides a fluidic channel for the communication of fluid (or ink) with drop ejecting elements 31 through substrate 40.

In one embodiment, drop ejecting elements 31 include a first array of drop ejecting elements 31 and a second array of drop ejecting elements 31. The first array of drop ejecting elements 31 are positioned to a first side of first opening 44 and the second array of drop ejecting elements 31 are positioned to a second side of first opening 44. As such, a first array 341 of firing resistors 34 are positioned to a first side of first opening 44 and a second array 342 of firing resistors 34 are positioned to a second side of first opening 44.

Figure 4:
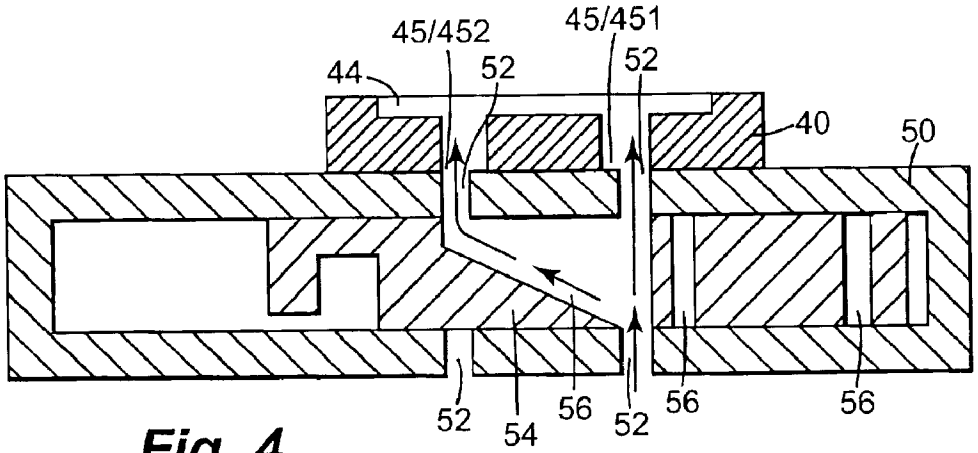
FIG. 4 is a schematic cross-sectional view illustrating one embodiment of a portion of a fluid ejection device, including supplying fluid to the fluid ejection device.
Figure 5:
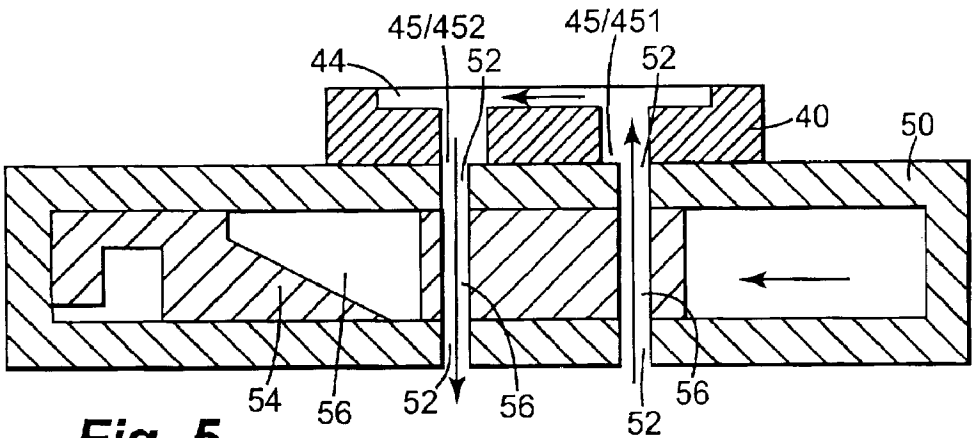
FIG. 5 is a schematic cross-sectional view illustrating the fluid ejection device of FIG. 4, including circulating fluid through the substrate.

In one embodiment, as illustrated in FIGS. 4 and 5, substrate 40 is supported by a fluid manifold 50. Fluid manifold 50 includes a plurality of fluid passages 52 which distribute fluid through substrate 40. More specifically, fluid passages 52 supply fluid to and circulate fluid through substrate 40, as described below.

In one embodiment, a valve 54 is associated with fluid manifold 50. Valve 54 is moved between one or more positions to selectively distribute fluid through fluid manifold 50. As such, valve 54 includes a plurality of fluid passages 56 which distribute fluid between fluid passages 52 of fluid manifold 50.

As illustrated in the embodiment of FIG. 4, valve 54 is positioned in a first position so as to supply fluid to second openings 45 of substrate 40. More specifically, fluid passages 56 of valve 54 are positioned so as to distribute fluid to fluid passages 52 of fluid manifold 50 which communicate with second openings 45 of substrate 40 such that fluid is supplied to each second opening 45 of substrate 40. Valve 54 is positioned in the first position during, for example, operation of fluid ejection device 30. During operation of fluid ejection device 30, one or more drop ejecting elements 31 (FIG. 3) eject fluid as supplied through second openings 45 to first opening 44.

As illustrated in the embodiment of FIG. 5, valve 54 is positioned in a second position so as to circulate fluid through substrate 40. More specifically, one fluid passage 56 of valve 54 is positioned so as to distribute fluid to one fluid passage 52 of fluid manifold 50 which communicates with one second opening 45 of substrate 40. In addition, one fluid passage 56 of valve 54 is positioned so as to receive fluid from another fluid passage 52 of fluid manifold 50 which communicates with another second opening 45 of substrate 40. As such, fluid is circulated through second openings 45 of substrate 40. As second openings 45 of substrate 40 communicate with first opening 44 of substrate 40, fluid is circulated through first opening 44 and, more specifically, substrate 40. In one embodiment, valve 54 is intermittently positioned in the second position while fluid ejection device 30 and, more specifically, drop ejecting elements 31 (FIG. 3) are not operated.

As illustrated in the embodiment of FIGS. 4 and 5, second openings 45 of substrate 40 include a first second opening 451 and a second second opening 452 each spaced along second side 43 of substrate 40. As such, in one position, as illustrated in FIG. 4, fluid manifold 50 and valve 54 are configured such that fluid passages 52 and 56 supply fluid to first second opening 451 and second second opening 452. Thus, first second opening 451 and second second opening 452 supply fluid to first opening 44 of substrate 40 and, therefore, to drop ejecting elements 31 (FIG. 3) of fluid ejection device 30.

In another position, as illustrated in FIG. 5, fluid manifold 50 and valve 54 are configured such that fluid passages 52 and 56 supply fluid to first second opening 451 and receive fluid from second second opening 452. Thus, first second opening 451 and second second opening 452 circulate fluid through first opening 44 of substrate 40 and, therefore, among drop ejecting elements 31 (FIG. 3) of fluid ejection device 30.

Figure 6:
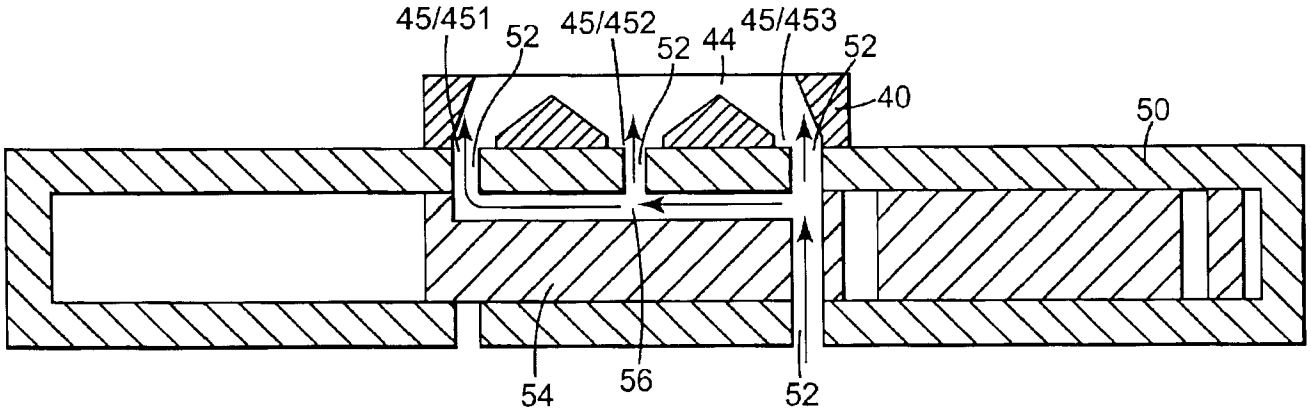
FIG. 6 is a schematic cross-sectional view illustrating another embodiment of a portion of a fluid ejection device, including supplying fluid to the fluid ejection device.
Figure 7:
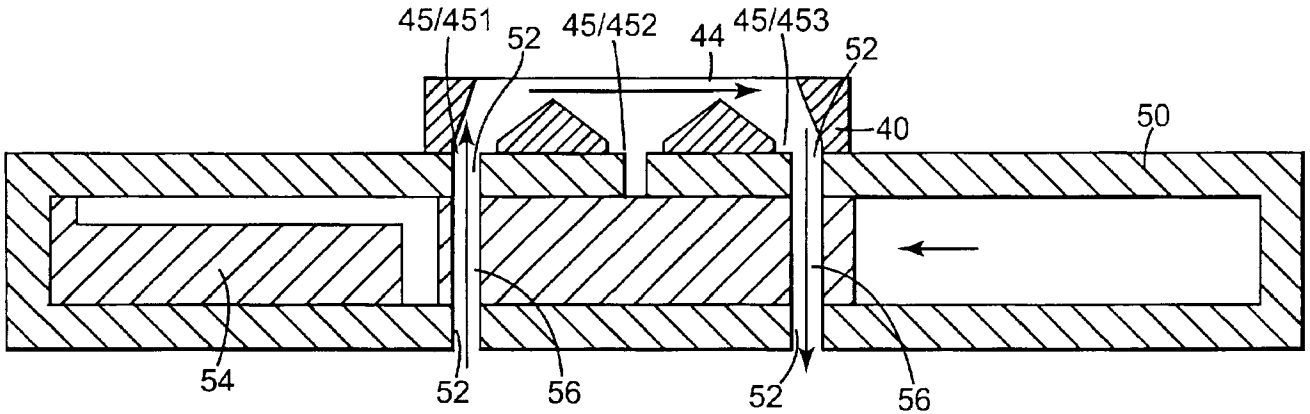
FIG. 7 is a schematic cross-sectional view illustrating the fluid ejection device of FIG. 6, including one embodiment of circulating fluid through the substrate.
Figure 8:
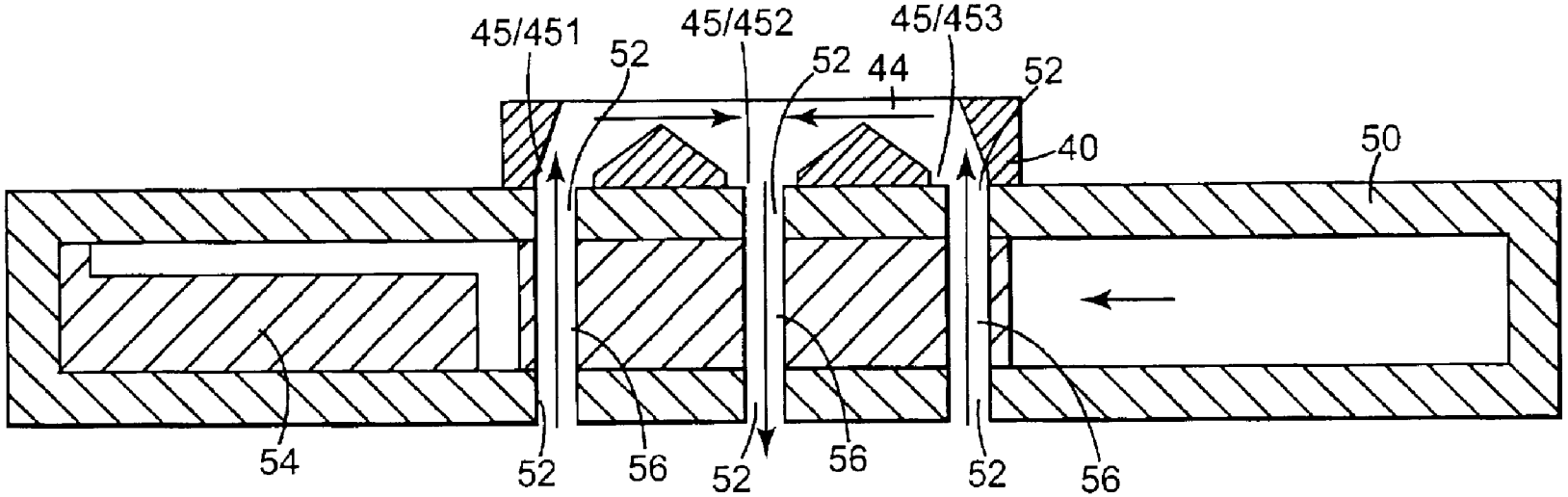
FIG. 8 is a schematic cross-sectional view illustrating the fluid ejection device of FIG. 6, including another embodiment of circulating fluid through the substrate.

In another embodiment, as illustrated in FIGS. 6–8, second openings 45 of substrate 40 include a first second opening 451, a second second opening 452, and a third second opening 453. As such, in one position, as illustrated in FIG. 6, fluid manifold 50 and valve 54 are configured such that fluid passages 52 and 56 supply fluid to first second opening 451, second second opening 452, and third second opening 453. Thus, first second opening 451, second second opening 452, and third second opening 453 supply fluid to first opening 44 of substrate 40 and, therefore, to drop ejecting elements 31 (FIG. 3) of fluid ejection device 30.

In another position, as illustrated in FIG. 7, fluid manifold 50 and valve 54 are configured such that fluid passages 52 and 56 supply fluid to first second opening 451 and receive fluid from third second opening 453. In addition, second second opening 452 is blocked such that fluid does not pass through second second opening 452. Thus, first second opening 451 and third second opening 453 circulate fluid through first opening 44 of substrate 40 and, therefore, among drop ejecting elements 31 (FIG. 3) of fluid ejection device 30.

In another embodiment, as illustrated in FIG. 8, fluid manifold 50 and valve 54 are configured such that fluid passages 52 and 56 supply fluid to first second opening 451 and third second opening 453, and receive fluid from second second opening 452. Thus, first second opening 451, second second opening 452, and third second opening 453 circulate fluid through first opening 44 of substrate 40 and, therefore, among drop ejecting elements 31 (FIG. 3) of fluid ejection device 30. It is understood that the number of second openings 45 in substrate 40 may vary and that the configuration of fluid manifold 50 and/or valve 54, including fluid passages 52 and/or 56, may also vary to supply fluid to and/or circulate fluid through substrate 40.

By circulating fluid through the substrate, air bubbles and/or particles which may collect within the fluid ejection device and degrade operation of the fluid ejection device can be removed. More specifically, by circulating fluid through the substrate among the drop ejecting elements, air bubbles and/or particles which may collect within the opening of the substrate can be removed from the fluid ejection device. In addition, heat which may be generated during operation of the drop ejecting elements and can also affect operation of the fluid ejection device, may be dissipated by circulating fluid through the substrate.

A flow velocity of fluid through the substrate is selected, for example, so as to dislodge air bubbles and/or particles which may collect within the opening of the substrate as well as dissipate heat generated during operation of the drop ejecting elements. The flow velocity of fluid through the substrate is fluid dependent as well as surface dependent. In one illustrative embodiment, the flow velocity is greater than approx 5 cm/sec. In another illustrative embodiment, the flow velocity is in a range of approximately 5 cm/sec to approximately 15 cm/sec. In addition, in one illustrative embodiment, a pressure drop through the substrate of approximately 20 inches-of-water or less is acceptable for re-circulation flow. In one illustrative embodiment, a pressure drop through the substrate of approximately 6 inches-of-water or less is acceptable during printing. The pressure drop through the substrate is fluid dependent and geometry dependent, including a size and number of the openings in the substrate.

While the above description refers to the inclusion of substrate 40 having opening 46 (including first opening 44 and second openings 45) formed therein in an inkjet printhead assembly, it is understood that substrate 40 having opening 46 formed therein may be incorporated into other fluid ejection systems including non-printing applications or systems as well as other applications having fluidic channels through a substrate, such as medical devices. Accordingly, the present invention is not limited to printheads, but is applicable to any slotted substrates.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A fluid ejection device, comprising:

a substrate having a first side and a second side opposite the first side and including a first opening formed in the first side and a plurality of second openings formed in the second side, each of the second openings communicating with the first opening;

a valve communicated with the second openings; and a plurality of drop ejecting elements formed on the first side of the substrate, each of the drop ejecting elements including a chamber, a resistor formed in the chamber, and a nozzle associated with the chamber, wherein the valve, the second openings and the first opening are adapted to circulate fluid through the substrate.

2. The fluid ejection device of claim 1, wherein the second openings and the first opening are adapted to supply fluid to the drop ejecting elements.

3. The fluid ejection device of claim 1, wherein the second openings and the first opening are adapted to circulate fluid among the drop ejecting elements.

4. The fluid ejection device of claim 1, wherein at least one of the second openings is adapted to selectively supply fluid to the first opening and at least another of the second openings is adapted to selectively receive fluid from the first opening to circulate fluid through the substrate.

5. The fluid ejection device of claim 1, wherein each of the second openings are adapted to selectively supply fluid to the first opening to supply fluid to the drop ejecting elements.

6. The fluid ejection device of claim 1, further comprising:

a fluid manifold adapted to distribute fluid through the second openings of the substrate.

7. The fluid ejection device of claim 6, wherein the fluid manifold is adapted to supply fluid to at least one of the second openings and receive fluid from at least another of the second openings to circulate fluid through the substrate.

8. The fluid ejection device of claim 6, wherein the fluid manifold is adapted to supply fluid to each of the second openings to supply fluid to the drop ejecting elements.

9. The fluid ejection device of claim 1, wherein the drop ejecting elements include a first array of drop ejecting elements positioned to a first side of the first opening and a second array of drop ejecting elements positioned to a second side of the first opening, wherein the second openings and the first opening are adapted to circulate fluid along the first opening between the first array of drop ejecting elements and the second array of drop ejecting elements.

10. The fluid ejection device of claim 1, wherein the substrate is a silicon substrate.

11. The fluid ejection device of claim 1, wherein at least one of the second openings is adapted to be selectively blocked to circulate fluid through the substrate.

12. A fluid ejection device, comprising:

a substrate having a first side and a second side opposite the first side and including a first opening formed in the first side and a plurality of second openings formed in the second side, each of the second openings communicating with the first opening; and a plurality of drop ejecting elements formed on the first side of the substrate, each of the drop ejecting elements including a chamber, a resistor formed in the chamber, and a nozzle associated with the chamber, wherein the second openings and the first opening are adapted to circulate fluid through the substrate, and wherein at least one of the second openings is adapted to be selectively blocked to circulate fluid through the substrate.

13. The fluid ejection device of claim 12, wherein the second openings and the first opening are adapted to circulate fluid among the drop ejecting elements.

14. The fluid ejection device of claim 12, wherein at least one of the second openings is adapted to selectively supply fluid to the first opening and at least another of the second openings is adapted to selectively receive fluid from the first opening to circulate fluid through the substrate.

15. A fluid ejection device, comprising:

a substrate having a first side and a second side opposite the first side and including a first opening formed in the first side and a plurality of second openings formed in the second side, each of the second openings communicating with the first opening;

a plurality of drop ejecting elements formed on the first side of the substrate;

a fluid manifold adapted to distribute fluid through the second openings of the substrate; and a valve adapted to selectively distribute fluid through the fluid manifold, wherein the second openings and the first opening are adapted to circulate fluid through the substrate.

16. The fluid ejection device of claim 15, wherein the valve is adapted to selectively supply fluid to the second opening and selectively circulate fluid through the second openings.

17. The fluid ejection device of claim 15, wherein the valve is adapted to move between a first position to supply fluid to each of the second openings, and a second position to supply fluid to at least one of the second openings and receive fluid from at least another of the second openings.

18. A method of distributing fluid in a fluid ejection device including a substrate having a first opening formed in a first side thereof and a plurality of second openings formed in a second side thereof, and a plurality of drop ejecting elements formed on the first side of the substrate, each of the second openings communicating with the first opening, the method comprising:

selectively supplying fluid to the drop ejecting elements via the second openings and the first opening, including positioning a valve of the fluid ejection device in a first position and distributing fluid to each of the second openings; and selectively circulating fluid through the substrate via the second openings and the first opening, including positioning the valve of the fluid ejection device in a second position and supplying fluid to at least one of the second openings and receiving fluid from at least another of the second openings.

19. The method of claim 18, wherein selectively circulating fluid through the substrate includes intermittently circulating fluid through the substrate via the second openings and the first opening.

20. The method of claim 18, wherein selectively circulating fluid through the substrate includes circulating fluid among the drop ejecting elements.

21. The method of claim 18, wherein selectively circulating fluid through the substrate includes supplying fluid to the first opening via at least one of the second openings and receiving fluid from the first opening via at least another of the second openings.

22. The method of claim 18, wherein selectively supplying fluid to the first opening includes supplying fluid to the first opening via each of the second openings.

23. The method of claim 18, wherein selectively circulating fluid through the substrate includes blocking at least one of the second openings.

24. The method of claim 18, wherein the drop ejecting elements of the fluid ejection device include a first array of drop ejecting elements positioned to a first side of the first opening and a second array of drop ejecting elements positioned to a second side of the first opening, wherein selectively circulating fluid through the substrate includes circulating fluid along the first opening between the first array of drop ejecting elements and the second array of drop ejecting elements.

25. The method of claim 18, wherein the substrate of the fluid ejection device is formed of silicon.

26. A method of operating a fluid ejection device including a substrate having a first opening formed in a first side thereof and a plurality of second openings formed in a second side thereof, and a plurality of drop ejecting elements formed on the first side of the substrate, each of the second openings communicating with the first opening, the method comprising:

supplying fluid to the drop ejecting elements via the second openings and the first opening, including positioning a valve of the fluid ejection device in a first position and distributing fluid to each of the second openings;

ejecting fluid from at least one of the drop ejecting elements;

discontinuing ejecting fluid from the at least one of the drop ejecting elements; and circulating fluid through the substrate via the second openings and the first opening, including positioning the valve of the fluid ejection device in a second position and supplying fluid to at least one of the second openings and receiving fluid from at least another of the second openings.

27. The method of claim 26, wherein circulating fluid through the substrate includes intermittently circulating fluid through the substrate via the second openings and the first opening.

28. The method of claim 26, wherein circulating fluid through the substrate includes circulating fluid among the drop ejecting elements.

29. The method of claim 26, wherein circulating fluid through the substrate includes supplying fluid to the first opening via at least one of the second openings and receiving fluid from the first opening via at least another of the second openings.

30. The method of claim 26, wherein supplying fluid to the drop ejecting elements includes supplying fluid to the first opening via each of the second openings.

31. The method of claim 26, wherein circulating fluid through the substrate includes blocking at least one of the second openings.

32. The method of claim 26, wherein the drop ejecting elements of the fluid ejection device include a first array of drop ejecting elements positioned to a first side of the first opening and a second array of drop ejecting elements positioned to a second side of the first opening, wherein circulating fluid through the substrate includes circulating fluid along the first opening between the first array of drop ejecting elements and the second array of drop ejecting elements.

33. The method of claim 26, wherein the substrate of the fluid ejection device is formed of silicon.

34. A fluid ejection device, comprising:

a substrate having a first side and a second side opposite the first side and including a first opening formed in the first side and a plurality of second openings formed in the second side, each of the second openings communicating with the first opening;

a plurality of drop ejecting elements formed on the first side of the substrate and communicating with the first opening; and means for selectively distributing fluid to the second openings and selectively circulating fluid through the second openings.

35. The fluid ejection device of claim 34, wherein means for selectively distributing fluid and selectively circulating fluid includes means for selectively supplying fluid to each of the second openings and means for selectively supplying fluid to at least one of the second openings and receiving fluid from at least another of the second openings.

36. The fluid ejection device of claim 35, wherein means for selectively distributing fluid and selectively circulating fluid further includes means for blocking at least one of the second openings.

37. The fluid ejection device of claim 34, wherein means for selectively distributing fluid and selectively circulating fluid includes a valve adapted to supply fluid to each of the second openings when in a first position, and adapted to supply fluid to at least one of the second openings and receive fluid from at least another of the second openings when in a second position.

38. The fluid ejection device of claim 34, wherein each of the drop ejecting elements include a chamber communicated with the first opening, a resistor formed in the chamber, and a nozzle associated with the chamber.

* * * * *